United States Patent [19]

Bradley

[11] Patent Number: 5,063,681

[45] Date of Patent: Nov. 12, 1991

[54] DUAL CHALK LINE MARKER

[76] Inventor: Oliver A. Bradley, 1185 Park Center Dr., Vista, Calif. 92083

[21] Appl. No.: 670,686

[22] Filed: Mar. 18, 1991

[51] Int. Cl.[5] ..... B44D 3/38

[52] U.S. Cl. ..... 33/414

[58] Field of Search ..... 33/413, 414

[56] References Cited

U.S. PATENT DOCUMENTS

| | | |
|---|---|---|
| 665,119 | 1/1901 | Latter . |
| 986,171 | 3/1911 | Hoover . |
| 1,004,443 | 9/1911 | Laut . |
| 3,078,581 | 2/1963 | Foster . |
| 3,126,637 | 3/1964 | Short . |
| 3,206,855 | 9/1965 | Fletcher . |
| 4,565,011 | 1/1986 | Karger . |

*Primary Examiner*—Harry N. Haroian

*Attorney, Agent, or Firm*—Calif Kip Tervo

[57] ABSTRACT

A chalk line assembly and a pair of spreader allow two spaced apart chalk lines to be marked simultaneously. A chalk line assembly includes a chalk line, a spool, a box, and a crank. The chalk line has two ends wound on the spool and a middle portion forming a bight having a first side, a second side and an outer end. The box confines the spool and provides a bearing therefore, confines a body of powdered chalk and includes an aperture for passage of the chalk line from the box. The crank is connected to the spool for rotating the spool to wind up the chalk line. A pair of spreaders include a first spreader for receiving the line middle portion from the spool and includes a pair of spaced apart ports through which the line middle portion passes. The second spreader is slidably connected to the bight outer end and includes a spaced apart pair of ports through which the chalk line passes.

15 Claims, 2 Drawing Sheets

DUAL CHALK LINE MARKER

BACKGROUND OF THE INVENTION

1. Field of the Invention

This invention relates in general to a chalk line device for marking a line such as during building construction and more particularly involves a chalk line device for playing out a pair of spaced apart chalk lines.

2. Background of the Invention

Chalk line devices that dispense a chalk covered string or line for marking surfaces, such as in building construction, are well known in the art. In use, typically, the chalk line outer end terminates in a grommet that is placed over a nail on the line to be marked. The user then moves to the other end of the line to be marked and places the chalk line over it. The line is snapped to place a chalk line between the two points.

Many times it is desirable to place two chalk lines adjacent one another. For example, in laying out a wall, it is desirable to have two parallel chalk lines three and a half inches apart to mark wall stud placement. Conventionally , this requires the worker to make four trips the length of the marked line and to make several sets of measurements.

Therefore, it is desirable to have a dual chalk line marker that is capable of marking two spaced apart chalk lines simultaneously.

DETAILED DESCRIPTION OF THE INVENTION

Figure 1:
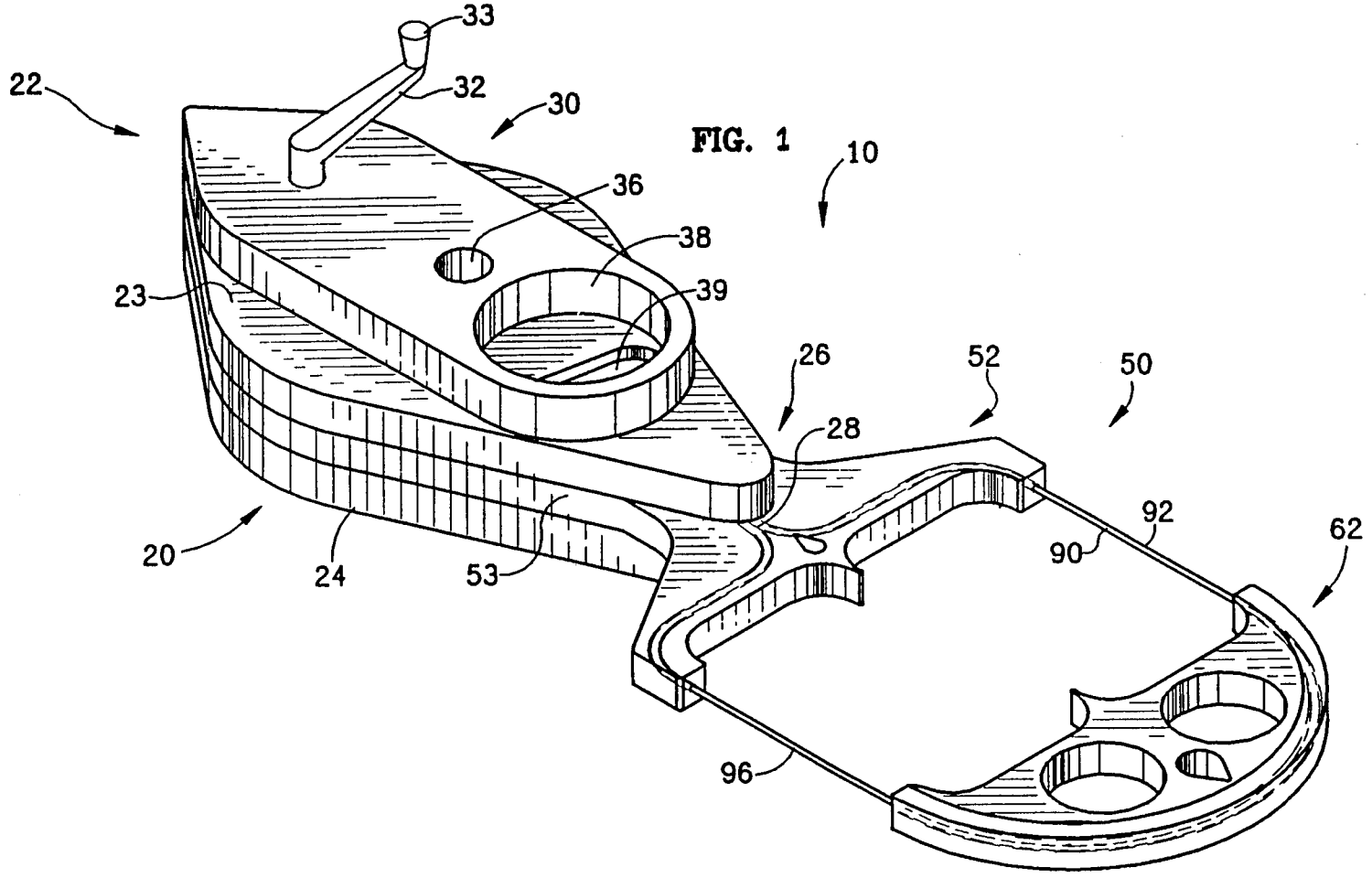
FIG. 1 is a perspective view of a preferred embodiment of the dual chalk line marker of the present invention.
Figure 2:
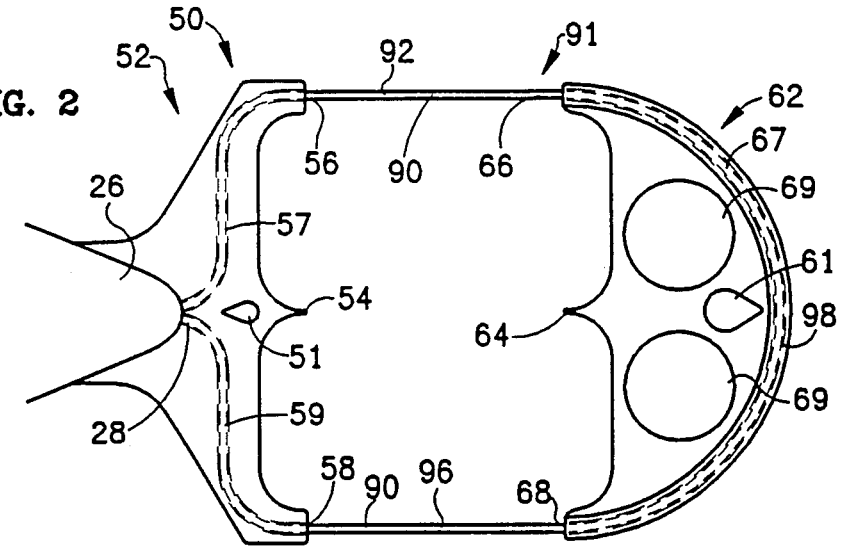
FIG. 2 is a top plan view of the line spreaders and chalk lines of FIG. 1.

With reference now to the drawing, and more particularly to FIGS. 1 and 2 thereof, there is shown a preferred embodiment of the dual chalk line marker, denoted generally as 10, of the present invention.

Dual chalk line marker 10 is generally comprised of a rather conventional chalk line assembly, denoted generally as 20, for storing and dispensing a chalk line, and a pair of line spreaders, denoted generally as 50.

Chalk line assembly 20 includes a tear shaped housing 22 comprised of top housing half 23 and a bottom housing half 24 joined by any suitable means, such as screw fasteners. Housing 22 encloses a spool chamber including a spool for receiving a chalk line. Housing 22 provides bearing means so that the spool can rotate. A crank assembly, denoted generally as 30, provides an external means for turning the spool. Crank assembly 30 includes a folding crank 32 with rotating end knob 33. Crank is rotated in a circle whereby appropriate gearing linked to the spool turns the spool and reels in chalk line. Crank lock hole 36 receives the crank end knob which prevents the crank from rotation and locks the spool on place. Housing 22 provides a chamber for confining powdered chalk and for exposing the chalk line to powdered chalk. Chalk well 38 includes an aperture 39 into the interior of housing 22 for introduction of chalk. Housing 22 includes a line feed end 26 including an aperture or apertures 28 through which chalk line 90 passes.

The above is a rather generic description of a typical chalk line assembly 20.

Attached to chalk line assembly 20 is spreader means, such as spreader device 50, for retaining two chalk line segments 92,96 in spaced apart relationship. Spreader device 50 generally comprises inner or first spreader 52 and outer or second spreader 62.

In the preferred embodiment of the invention illustrated in FIGS. 1 and 2, the spool means of chalk line assembly 20 is designed to reel in both ends of a chalk line 90. Although the term spool is used in the singular, it is understood that, for this purpose, a single spool, bifurcated with a partition, could be used or two separate spools could be employed. Chalk line 90 inner ends are both wound on the spool and the chalk line middle portion forms a bight 91 including a first side 92, a second side 96 and an outer end 98.

In the preferred embodiment shown, inner spreader 52 is attached to housing 22 as an insert 53 placed between top half housing 23 and bottom half housing 24. Tear shaped opening 51 can be used to attach spreader 50 to an alignment projection, such as a nail or the like.

As best seen in FIG. 2, basically, inner spreader 52 receives line 90 from the spool and channels it out of two spaced apart ports, first port 56 and second port 58. Inner spreader 52 includes a pair of channels 57,59 therethrough through which the line 90 freely passes. Channels 57, 59 receive line bight first side and second side 92, 96 respectively from the spool and channel them to first and second ports 56, 58 respectively.

Center line indicator means, such as point 54, is located midway between ports 56,58.

Second or outer spreader 62 includes a channel 67 passing therethrough through which the outer end 98 of line bight 91 freely passes. Channel 67 terminates at a pair of spaced apart ports 66,68. Outer spreader first port 66 receives bight first side 92 from inner spreader first port 56. Outer spreader second port 68 passes bight second side to inner spreader second port 58.

Tear shaped opening 61 can be used to attach spreader 62 to an alignment projection, such as a nail or the like driven in a center line. Center line indicator means, such as point 54, is located midway between ports 66,68. Finger openings 69 aid in manipulation of the spreader.

In use, as spreaders 52,62 are separated to play out the bights 92,96 of chalk line 90, the spool unwinds the line 90. Any inconsistancy in the amount of line 90 unwound from the spool to either bight side 92,96 is adjusted for by line movement through channel 67 between outer spreader ports 66 and 68. In this manner, both bights 92,96 remain straight and taut.

Ports 56,58 and 66,68 may be equally spaced apart such that bight sides 92, 96 are parallel. A good use for this configuration is in marking wall footings in housing construction. With the ports three and one half inches apart, by placing points 54,64 or openings 51,61 on a footing center line, the lines 92,96 will mark both inner wall lines.

Figure 3:
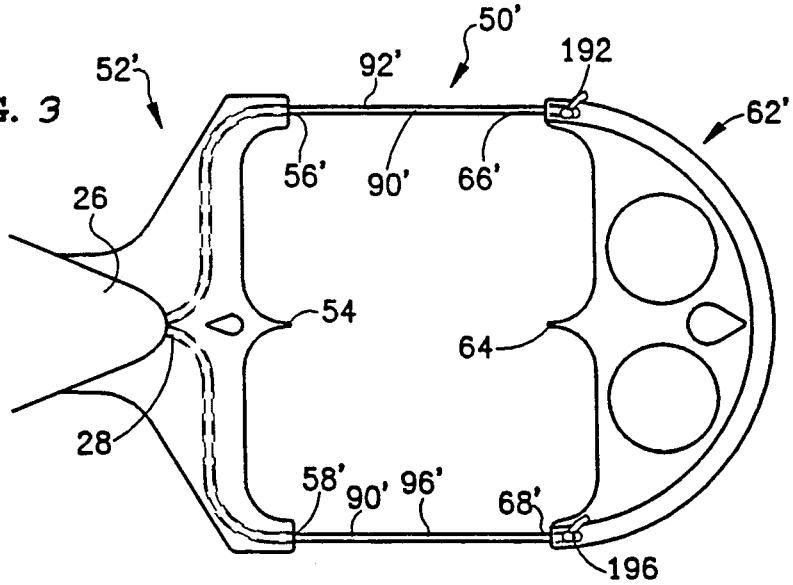
FIG. 3 is a top plan view of the line spreaders and chalk lines of an alternate embodiment of the invention.

FIG. 3 illustrates in top plan view another embodiment of the invention having a unique spreader device, denoted as 50'. Spreader device 50' is similar to that of FIGS. 1 and 2 except that line 90' is, in effect, two separate line segments 92', 96' respectively that emerge from ports 56',58' of first spreader 52' and terminate in outer ends 192,196 respectively, shown as knots attaching the lines 92',96' to outer spreader 62'. Lines 92', 96' are attached such that they pass through spaced apart ports 66', 68'.

Figure 4:
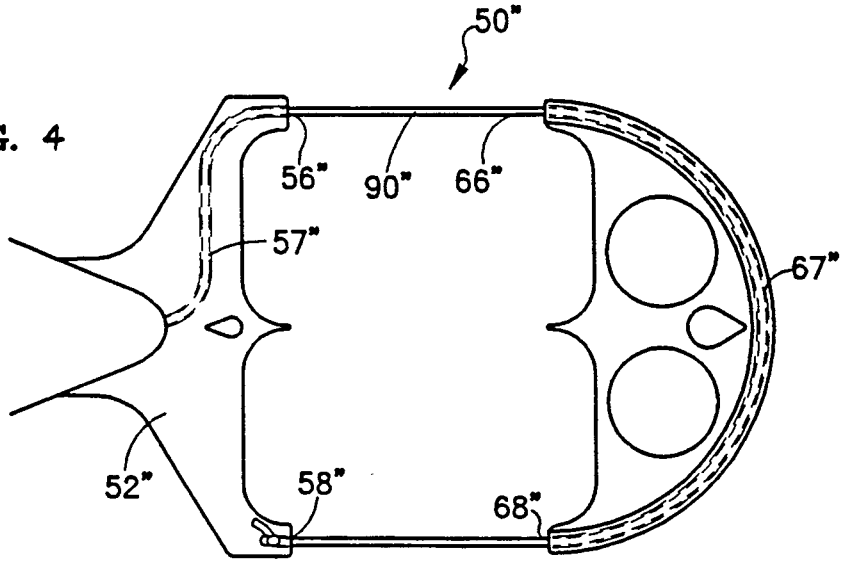
FIG. 4 is a top plan view of the line spreaders and chalk of still another alternate embodiment of the invention.

FIG. 4 illustrates still another embodiment of the invention having a unique spreader device 50'' that uses a single chalk line 90'' having an inner end wound on the spool and an outer end 192'' attached to inner spreader 52'' such that the line 90'' passes through first spreader second port 58''. Line 90'' passes from the spool through inner spreader channel 57'' and out first port 56''. Outer spreader 62'' is identical to that of FIG. 1. Line 90'' enters first port 66'', passes freely through channel 67'' and emerges through second port 68''. From second port 68'', line 90'' passes through first spreader second port 58'' and is secured as in a knot at the outer end 192''. The spreader device 50'' of FIG. 4 is the most readily adaptable to a conventional single spool chalk line assembly as a retro-fit device.

Having described the preferred embodiments of the present invention, many alterations and modifications which are within the scope of the invention will likely occur to those skilled in the art. For example, the spreaders may include means for adjusting the distance between the ports so that lines of various spacing may be chalked. Also, the channels as shown are not really necessary and the ports simply could be eyes.

Therefore, it is to be understood that all matter herein is to be interpreted as illustrative and not in any limiting sense, and it is intended to cover in the appended claims such modifications and changes as come within the true spirit and scope of the invention.

I claim:

1. A dual chalk line marker comprising:

a chalk line assembly including:

spool means for reeling two chalk lines;

a first chalk line wound on said spool means; said first chalk line having an outer end;

a second chalk line wound on said spool means; said second chalk line having an outer end;

crank means connected to said spool means for rotating said spool means to wind up said lines on said spool means;

box means, confining said spool means and providing a bearing therefore and for confining a body of powdered chalk and including aperture means for passage of said chalk lines; and a pair of spreader means including:

first spreader means means attached to said chalk lines for receiving said lines from said spool means; said first spreader including ports through which said lines pass including:

first port means from which said said first chalk line emerges; and second port means, separated from said first spreader first port means, from which said second chalk line emerges; and second spreader means including:

a first end port connected to said first chalk line outer end; and a second end port, separated from said first end port, connected to said second chalk line outer end.

2. The dual chalk line marker of claim 1 wherein:

said first spreader is attached to said box means.

3. The dual chalk line marker of claim 1 wherein:

each said spreader includes a midpoint indicator means for indicating the midpoint between its said ports.

4. The dual chalk line marker of claim 1 wherein:

said spreaders first ports are spaced the same distance from said spreaders second ports such that the chalked lines are parallel.

5. The dual chalk line marker of claim 1 wherein:

said second spreader includes an aperture therethrough midway between said end ports for attachment of said spreader to a protrusion on a centerline.

6. A dual chalk line marker comprising:

a chalk line assembly comprising:

spool means for reeling both ends of a chalk line;

a chalk line having two ends wound on said spool means and a middle portion forming a bight having a first side, a second side and an outer end;

crank means connected to said spool means for rotating said spool means to wind up said line ends on said spool means:

box means, confining said spool means and providing a bearing therefore, for confining a body of powered chalk and including aperture means for passage of said line bight;

a pair of spreader means including:

first spreader means for receiving said line middle portion from said spool means including ports through which said line middle portion passes including:

first port means from which said bight first side line emerges; and second port means, spaced apart from said first spreader first port, from which said bight second side line emerges; and second spreader means slidably connected to said bight outer end including:

a first end port for receiving said bight first side line from said first port means; and a second end port, spaced apart from said first end port, for receiving said bight second side line from said second port means; said line being able to pass freely between said first and second end ports.

7. The dual chalk line marker of claim 6 wherein:

said first spreader is attached to said box means.

8. The dual chalk line marker of claim 6 wherein:

each said spreader includes a midpoint indicator means for indicating the midpoint between its said ports.

9. The dual chalk line marker of claim 9 wherein:

said spreaders first ports are spaced the same distance from said spreaders second ports such that the chalked lines are parallel.

10. The dual chalk line marker of claim 6 wherein:

said second spreader includes an aperture therethrough midway between said end ports for attachment of said spreader to a protrusion on a centerline.

11. A dual chalk line marker comprising:

a chalk line assembly including:

spool means for a chalk line;

a chalk line having an inner end, an outer end, and a middle portion; said inner end wound on said spool means;

crank means connected to said spool means for rotating said spool means to wind up said line on said spool means;

box means, confining said spool means and providing a bearing therefore, for confining a body of powered chalk; including aperture means for passage therethrough of said chalk line; and a pair of spreader means including:

first spreader means including:

a port for receiving said line from said spool means and from which said line emerges; and an anchor point, spaced apart from said first spreader port, for receiving said line from a second spreader second end port including means for attaching said line end; and second spreader means slidably connected to said line middle portion including:

a first end port for receiving said line emerging from said first port; and a second end end port, spaced form said first end port from which said line emerges for passage to said anchor point; said line being able to pass freely between said said first and second end ports.

12. The dual chalk line marker of claim 11 wherein: said first spreader is attached to said box means.

13. The dual chalk line marker of claim 11 wherein: each said spreader includes a midpoint indicator means for indicating the midpoint between its said ports.

14. The dual chalk line marker of claim 11 wherein: said spreaders first ports are spaced the same distance from said spreaders second ports such that the chalked lines are parallel.

15. The dual chalk line marker of claim 11 wherein: said second spreader includes an aperture therethrough midway between said end ports for attachment of said spreader to a protrusion on a centerline.

* * * * *